US012247402B2

(12) United States Patent
Mitterbacher et al.

(10) Patent No.: US 12,247,402 B2
(45) Date of Patent: Mar. 11, 2025

(54) BRACKET ARRANGEMENT FOR HORIZONTALLY ARRANGED PROFILED SUPPORTS

(71) Applicant: Allface Befestigungstechnologie GmbH, Leobersdorf (AT)

(72) Inventors: Johannes Mitterbacher, Vienna (AT); Hans Jörg Drobesch, Klagenfurt (AT)

(73) Assignee: Allface Befestigungstechnologie GmbH, Leobersdorf (AT)

( * ) Notice: Subject to any disclaimer, the term of this patent is extended or adjusted under 35 U.S.C. 154(b) by 0 days.

(21) Appl. No.: 18/025,409

(22) PCT Filed: Sep. 9, 2021

(86) PCT No.: PCT/EP2021/074766
§ 371 (c)(1),
(2) Date: Mar. 9, 2023

(87) PCT Pub. No.: WO2022/053543
PCT Pub. Date: Mar. 17, 2022

(65) Prior Publication Data

US 2023/0332413 A1 Oct. 19, 2023

(30) Foreign Application Priority Data

Sep. 10, 2020 (AT) ..... A50764/2020

(51) Int. Cl.
*E06B 3/263* (2006.01)
*E04F 13/08* (2006.01)

(52) U.S. Cl.
CPC ..... *E04F 13/0805* (2013.01)

(58) Field of Classification Search
CPC .. E04F 13/0805; E04F 13/0857; E04F 13/081
See application file for complete search history.

(56) References Cited

U.S. PATENT DOCUMENTS 5,673,529 A * 10/1997 Treister ..... E04F 13/0803 52/235
8,621,802 B2 * 1/2014 Spyrou ..... E04B 1/388 52/489.1
11,560,709 B2 * 1/2023 Hatzinikolas ..... E04B 2/06

FOREIGN PATENT DOCUMENTS

DE 3005315 7/1985
EP 0065296 2/1987
(Continued)

OTHER PUBLICATIONS

Internationaler Recherchenbericht und Schriftlicher Bescheid [International Search Report and the Written Opinion] Dated Jan. 4, 2022 From the International Searching Authority Re. Application No. PCT/EP2021/074766 and Its Translation of Search Report Into English. (11 Pages).

*Primary Examiner* — Amy J. Sterling

(57) ABSTRACT

The invention relates to a bracket arrangement for receiving horizontally arranged profiled supports (4), preferably for fastening façade panels, wherein the bracket (2) has a fastening leg (6), a supporting leg (7) and a bracket head (5), wherein the supporting leg (7) and the bracket head (5) have a receiving slot (9) for receiving the profiled support (4), and wherein the bracket head (5) has a receiving opening (10) with an oblong hole-like cross section, and wherein a fixing screw (11), which projects into or can be plugged into the receiving opening (10), is provided for fastening the inserted profiled support (4).

9 Claims, 5 Drawing Sheets

(56) References Cited

FOREIGN PATENT DOCUMENTS

| | | |
|---|---|---|
| EP | 2918746 | 1/2017 |
| WO | WO 2005/021889 | 3/2005 |
| WO | WO 2008/049254 | 5/2008 |

* cited by examiner

BRACKET ARRANGEMENT FOR HORIZONTALLY ARRANGED PROFILED SUPPORTS

RELATED APPLICATIONS

This application is a National Phase of PCT Patent Application No. PCT/EP2021/074766 having International filing date of Sep. 9, 2021, which claims the benefit of priority of Austria Patent Application No. A50764/2020 filed on Sep. 10, 2020. The contents of the above applications are all incorporated by reference as if fully set forth herein in their entirety.

FIELD AND BACKGROUND OF THE INVENTION

The invention relates to a bracket assembly for receiving horizontally arranged support profiles, preferably for fastening facade panels, wherein the bracket has a fastening leg, a support leg and a bracket head.

Such brackets and bracket assemblies are widely used for cladding wall surfaces. Usually, brackets are mounted vertically on a load-bearing wall construction by means of dowels or screws. Support profiles are usually fastened horizontally with the brackets or bracket heads so that the facade panels can be fastened to the support profiles.

Known bracket assemblies of this kind have bracket heads that form a screw channel into which fastening screws are screwed and thus immovably fasten the support profile.

The disadvantage of such known bracket assemblies is that the thermal stresses occurring in facades lead to thermal expansion of the bracket parts and this leads to deformation of the facades. In the case of large facade surfaces, even relatively minor deformations play a major role, both in terms of appearance and stability. To date, brackets should not be shorter than a certain length, as longer brackets allowed little compensation for the thermal deformation of the support profiles due to bending. Furthermore, the length of the support profiles was limited and the number of brackets per support profile was reduced. A projection of the brackets was mostly only available from 120 mm, as, statically, the expansions could not be correctly measured.

SUMMARY OF THE INVENTION

The object of the present invention is to provide a bracket assembly that prevents the disadvantages mentioned and in which thermal expansions are compensated for entirely or to a large extent, so that the facades formed do not show any distortions. The bracket assembly according to the invention is also intended to enable small projections of the bracket, for example from 55 mm to about 255 mm. Furthermore, there should be no restriction on the lengths of the support profiles.

In addition, a correct static verification of the support profile expansion should be possible. A further object of the invention is the easy and safe mounting of the assembly.

The present invention is characterised in that the support leg and the bracket head have a receiving slot for horizontally receiving the support profile, and in that the bracket head has a receiving opening with a cross-section having the shape of an elongated hole, and in that a locking screw which projects or can be plugged into the receiving opening is provided for fastening the inserted support profile. The receiving opening is preferably arranged as an elongated hole transverse to the receiving slot and protrudes through it.

Preferably, the width of the receiving slot is greater than the thickness of the inserted support profile. This has the advantage that the support profile is not clamped in the slot.

The locking screw may be slidingly arranged in the receiving opening, wherein it is laterally displaceable in the receiving opening of the bracket head and stays displaceable even after screwing.

Furthermore, it may be provided that the locking screw has a self-tapping screw tip for screwing into the support profile. Preferably, a depth stop is provided to limit the depth of screwing into the bracket head and to ensure the displaceability of the support profile in the bracket head and its receiving slot.

The depth stop may be configured as a stop of the external screwing tool with which the locking screw is screwed in. An alternative may be to provide the locking screw with a stop shoulder along the screw thread.

The locking screw may preferably correspond in diameter to the width of the elongated hole of the receiving opening, so that the locking screw is guided in the receiving opening. According to the present invention, the locking screw may be guided by a sleeve in the receiving opening if the locking screw has a screw diameter that is smaller than the width of the receiving opening.

The locking screw may be fixed as a fixed-point screw by arranging a non-displaceable sleeve in the receiving opening.

The locking screw may be fixed in a non-displaceable manner by arranging a fixed-point claw in the receiving opening, wherein the fixed-point claw is supported against the support leg by two retaining legs.

Furthermore, at least two or more adjacent brackets may be provided, wherein one bracket for fixed-point fastening is fixedly connected to the support profile and the second bracket or further brackets for sliding-point fastening is (are) displaceably fastened.

BRIEF DESCRIPTION OF THE SEVERAL VIEWS OF THE DRAWINGS

In the following, the invention is explained in more detail with reference to exemplary embodiments.

DESCRIPTION OF SPECIFIC EMBODIMENTS OF THE INVENTION

Figure 1:
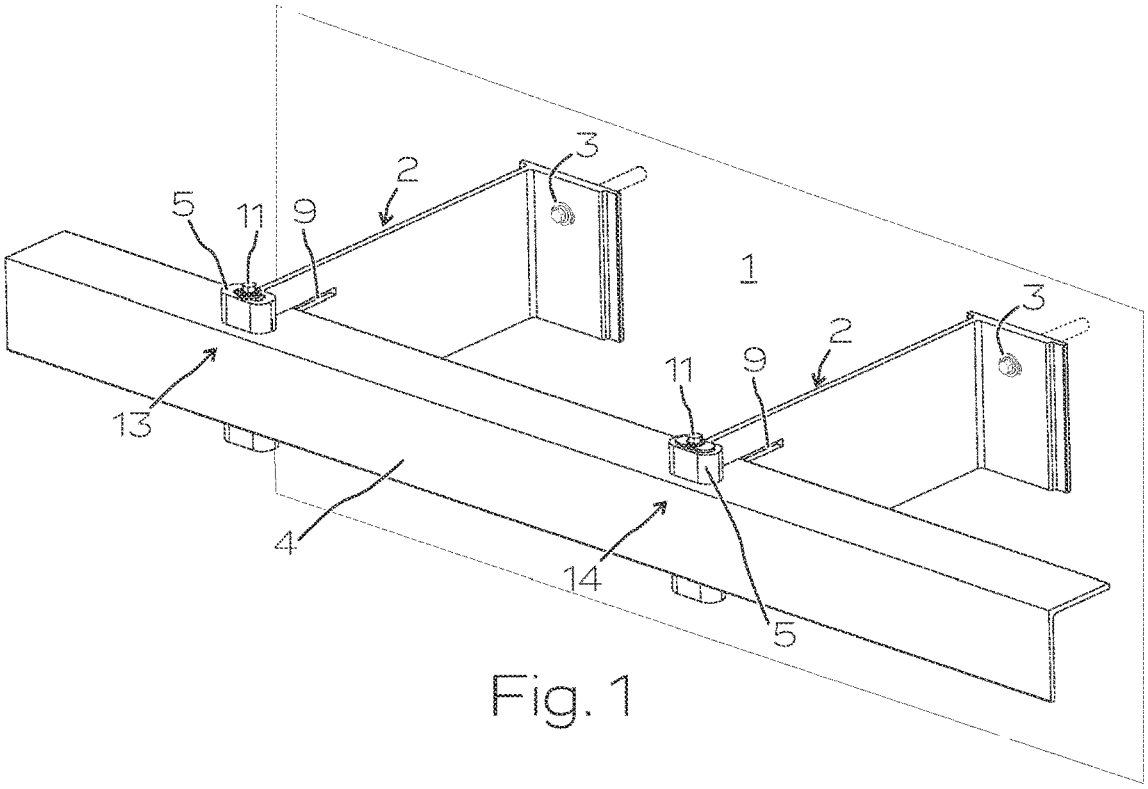
FIG. 1 shows a bracket assembly in an oblique view from above.

FIG. 1 shows a bracket assembly as it may be arranged on a wall construction 1. The wall construction 1 may be any stable construction capable of supporting the weight of the bracket assembly and any facade panels attached to it.

The wall construction 1 is merely hinted at.

The bracket assembly comprises two brackets 2 bent at an angle, which are fastened to the wall construction 1 with fastening screws 3. At the front end of the brackets 2, the support profile 4 runs in the horizontal direction, which is angular in the illustration, and the horizontally lying leg 17 of the support profile 4 is connected to the front part of the brackets 2 and the respective bracket heads 5. The support profile 4 is intended and configured to receive and hold facade elements that are not shown here. Such facade elements may be, for example, stone plates, glass plates or plastic panels. The space between the wall construction 1 and the support profile 4 and the preceding facade panels may, for example, be filled by an insulating material.

In FIG. 1, arrows indicate the locations of a sliding-point fastening 13 and a fixed-point fastening 14. In a facade construction, it is sometimes necessary to prevent the position of the support profile 4 from changing at certain points, the fixed-point positions, while displacement and thus stress compensation may be allowed at the sliding-point positions. With the construction according to the invention, both types of fastening may be implemented.

For the design of facades, a large number of such bracket assemblies may be distributed over the facade surface, side by side and one above the other. Exposure to sunlight and cold may result in considerable thermal loads on larger facade surfaces, which may deform the facade surfaces if the deformation is not counteracted by the design provided in accordance with the invention.

Figure 2:
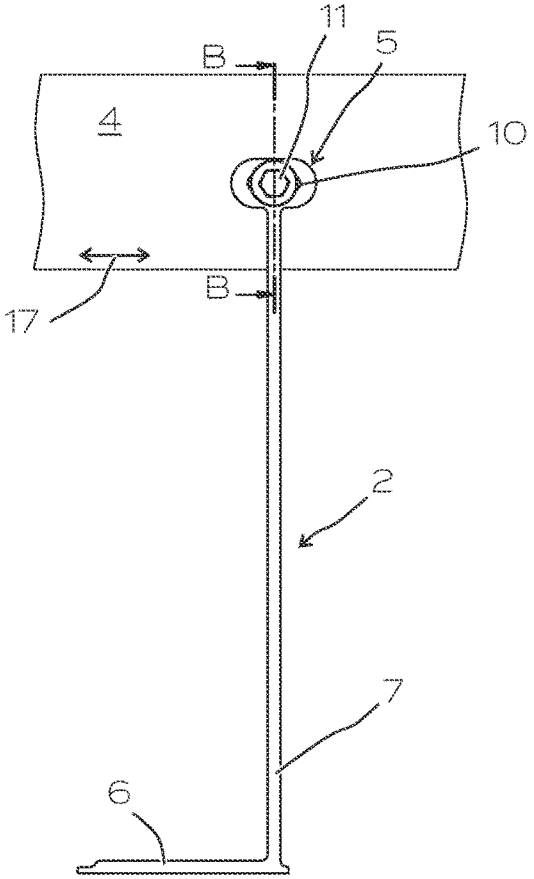
FIG. 2 is a top view of a bracket with an inserted support profile.
Figure 4:
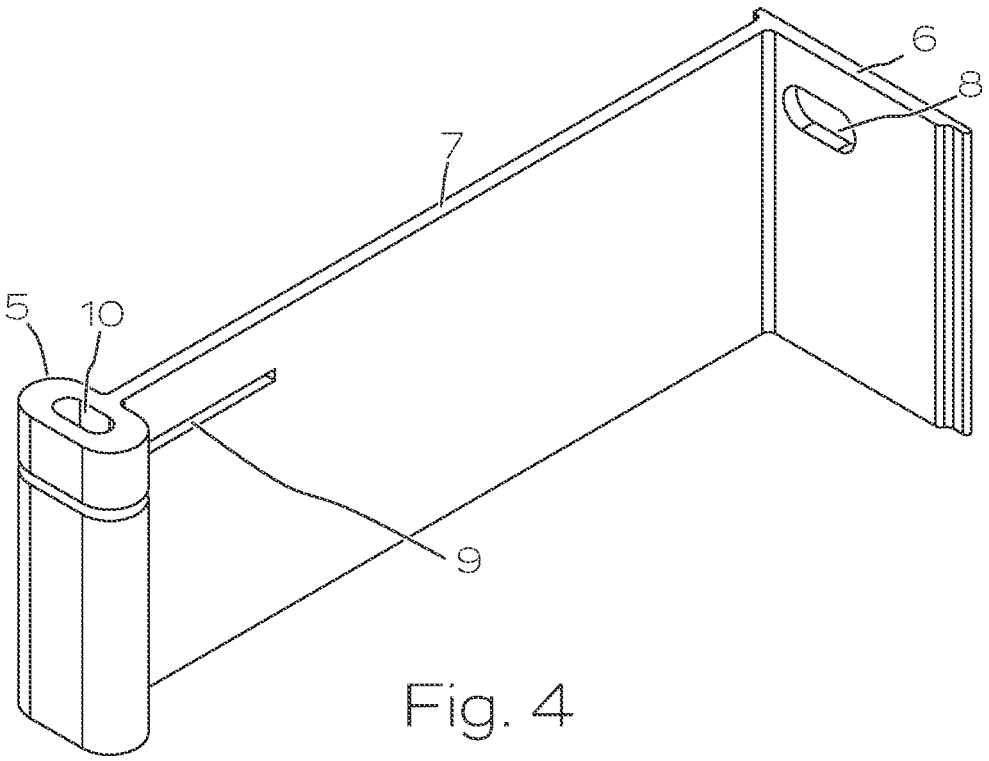
FIG. 4 shows an oblique view of the bracket.

The structure of the bracket 2 is best illustrated in FIGS. 2 and 4. The bracket 2 has a fastening leg 6, a support leg 7 and a bracket head 5. The bracket head 5 is solidly formed from the material of the bracket 2 and has a receiving opening 10 and a receiving slot 9 transversely thereto. The receiving slot 9 runs in the longitudinal direction of the bracket 2 and the receiving opening 10 runs in a perpendicular direction across the receiving slot 9.

As shown in particular in FIG. 4, the receiving opening 10 has a cross section corresponding to an elongated hole.

At the other end of the bracket 2, the fastening leg 6 is arranged with the fastening hole 8, which may, for example and as shown, be designed as an elongated hole. The fastening hole 8 serves to receive the fastening screw 3.

Figure 3:
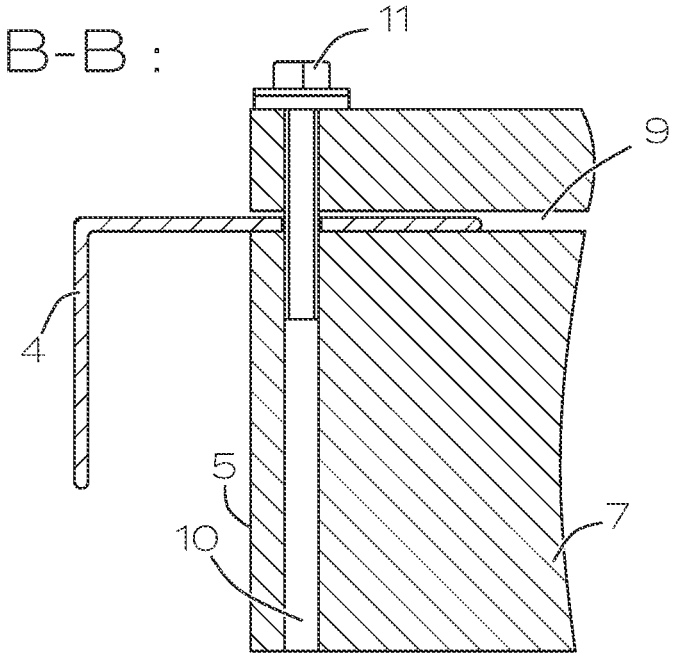
FIG. 3 shows a section along line B-B in FIG. 2.

FIG. 3 shows a section along the line B-B in FIG. 2. The upper horizontal leg of the support profile 4 is inserted into the receiving slot 9. As shown in FIG. 3, the width of the receiving slot 9 is slightly greater than the thickness of the material of the support profile 4. This prevents the support profile 4 from being clamped in the receiving slot 9.

However, the support profile 4 is held in place by the locking screw 11 so that the support profile 4 cannot be moved out of the receiving slot 9. As further shown in FIG. 3, the screw shaft of the locking screw 11 has a diameter approximately equal to the width of the receiving opening 10.

However, due to the design of the receiving opening 10 as an elongated hole, the locking screw 11 can be moved in the longitudinal direction of the elongated hole. This means that the support profile 4 is slightly movable in the direction of the arrow 17 (FIG. 2) so that thermal stress can be compensated for without significantly deforming the brackets 2 or the support profile 4. As a result of this mobility, it is also possible to use short brackets 2, which cannot be used in a rigid construction without a compensation possibility.

Figure 5:
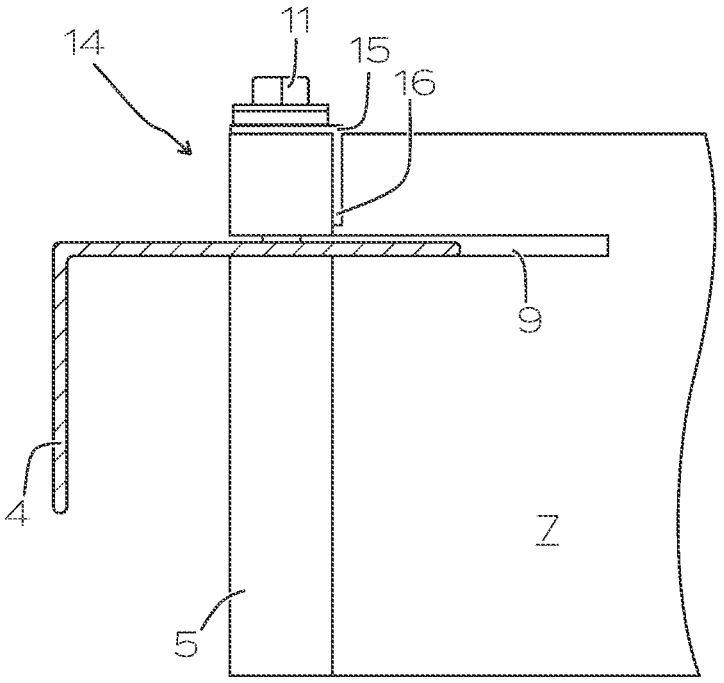
FIG. 5 shows a top view of the area of the bracket head with inserted support profile and a fixed-point claw.
Figure 6:
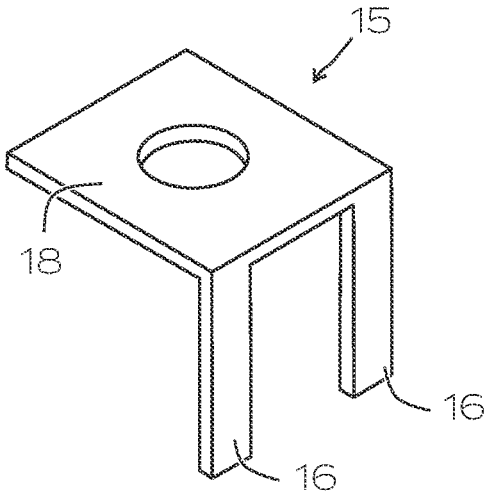
FIG. 6 shows an oblique view of a fixed-point claw.

FIGS. 5 and 6 show an advantageous possibility for a fixed-point fastening 14. For this purpose, a so-called fixed-point claw 15 is provided as a simple component, the leg 18 of which is fixed by the locking screw 11. The downward projecting retaining legs 16 surround the support leg 7 of the bracket 2 and this causes the immovable fixing of the locking screw 11 in the centre of the elongated hole of the receiving opening 10.

Figure 7:
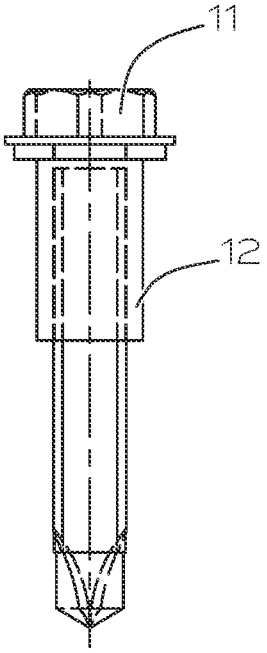
FIGS. 7 and 8 show a view of a locking screw with sleeve.
Figure 8:
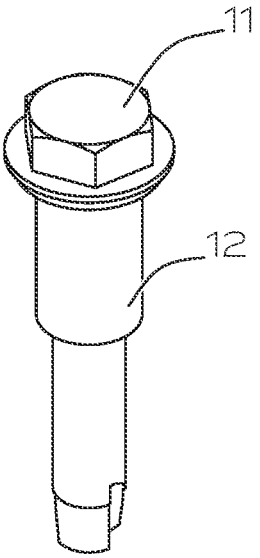

FIGS. 7 and 8 show a form of the locking screw 11 surrounded by a sleeve 12. It should be noted that the sleeve 12 may be omitted if the diameter of the locking screw 11 corresponds to the width of the receiving opening 10. The sleeve 12 has the purpose of making thinner screws usable in certain forms of application.

In any case, the locking screws 11 are preferably self-screwing screws that screw their own fastening hole in the support profile 4. However, screwing into the support profile 4 is limited by a depth stop. This limitation has the effect that the support profile 4 is not jammed, but remains displaceable for expansion compensation.

The depth stop may either be obtained by accordingly shaping the shaft of the locking screw 11, or a screwing tool may be provided which allows screwing only up to a certain depth.

Figure 9:
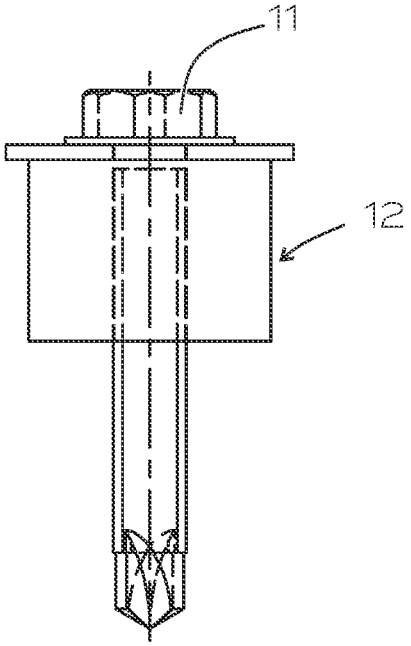
FIGS. 9 and 10 show a side view and an oblique view of a locking screw with a variation of the sleeve.
Figure 10:
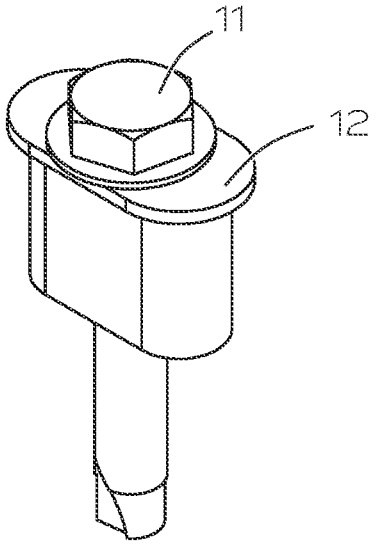

FIGS. 9 and 10 show a further design of the sleeve 12 for a fixed-point fastening 14. The sleeve 12 is designed in such a way that it fills the receiving opening of the bracket head 5 in such a way that mobility of the locking screw 11 is no longer possible.

For assembling purposes, the sleeves 12 are preferably used with the corresponding locking screws 11 as a unit in order to keep the number of individual parts as small as possible during assembling.

LIST OF REFERENCE SIGNS

1 Wall construction
2 Bracket
3 Fastening screw
4 Support profile
5 Bracket head
6 Fastening leg
7 Support leg
8 Fastening hole
9 Receiving slot
10 Receiving opening
11 Locking screw
12 Sleeve
13 Sliding-point fastening
14 Fixed-point fastening
15 Fixed-point claw
16 Retaining legs
17 Arrow
18 Leg

The invention claimed is:

1. A bracket assembly for receiving horizontally arranged support profiles, wherein the bracket has:

a fastening leg, a support leg and a bracket head, wherein the support leg and the bracket head have a receiving slot for horizontally receiving the support profile, and wherein the bracket head has a receiving opening with a cross-section having the shape of an elongated hole, and wherein the bracket assembly further comprising a locking screw which projects or can be plugged into the receiving opening for fastening the inserted support profile;

wherein the locking screw has a self-tapping screw tip for screwing into the support profile.

2. The bracket assembly according to claim 1, wherein the receiving opening is arranged transversely to the receiving slot and projects through the latter.

3. The bracket assembly according to claim 1, wherein the width of the receiving slot is greater than the thickness of the inserted support profile.

4. The bracket assembly according to claim 1, wherein the locking screw has a depth stop or can be screwed in by means of a depth stop.

5. The bracket assembly according to claim 1, wherein the locking screw is slidably and laterally displaceably arranged in the receiving opening, the diameter corresponding to the width of the elongated hole of the receiving opening.

6. The bracket assembly according to claim 1, wherein the locking screw is guided in the receiving opening by a sleeve.

7. The bracket assembly according to claim 1, wherein the locking screw is fixed in the receiving opening by arrangement of a non-displaceable sleeve.

8. A bracket assembly for receiving horizontally arranged support profiles, wherein the bracket has:

a fastening leg, a support leg and a bracket head, wherein the support leg and the bracket head have a receiving slot for horizontally receiving the support profile, and wherein the bracket head has a receiving opening with a cross-section having the shape of an elongated hole, and wherein the bracket assembly further comprising a locking screw which projects or can be plugged into the receiving opening for fastening the inserted support profile;

wherein the locking screw is fixed in a non-displaceable manner by the arrangement of a fixed-point claw in the receiving opening, the fixed-point claw being supported against the support leg by two retaining legs.

9. A bracket assembly for receiving horizontally arranged support profiles, wherein the bracket has:

a fastening leg, a support leg and a bracket head, wherein the support leg and the bracket head have a receiving slot for horizontally receiving the support profile, and wherein the bracket head has a receiving opening with a cross-section having the shape of an elongated hole, and wherein the bracket assembly further comprising a locking screw which projects or can be plugged into the receiving opening for fastening the inserted support profile;

wherein at least two brackets adjacent to one another are provided, wherein one bracket is fixedly connected to the support profile for fixed-point fastening and the second bracket or further brackets is (are) displaceably fastened for sliding-point fastening.

* * * * *